United States Patent [19]

Ecker

[11] Patent Number: 4,928,857

[45] Date of Patent: May 29, 1990

[54] HAND OPERATED SOAP DISPENSER

[76] Inventor: Frederick K. Ecker, 8402 Shady Glen Dr., Orlando, Fla. 32819

[21] Appl. No.: 50,043

[22] Filed: May 15, 1987

[51] Int. Cl.[5] ..... B65D 37/00

[52] U.S. Cl. ..... 222/211; 222/190; 366/130

[58] Field of Search ..... 222/190, 206, 211–213, 222/215, 224, 196.1, 196.5; 366/604, 130, 102, 103, 106; 206/77.1; 422/129.1, 266, 283; 241/602; 401/4, 143, 118; 220/367, 368

[56] References Cited

U.S. PATENT DOCUMENTS

| | | | |
|---|---|---|---|
| 404,354 | 5/1889 | Huber | 422/266 |
| 1,472,643 | 10/1923 | Fleming et al. | 220/367 |
| 1,537,552 | 5/1925 | Rotunno | 222/190 X |
| 1,554,148 | 9/1925 | Waler | 266/604 X |
| 2,403,691 | 7/1946 | States | 220/367 |
| 2,477,998 | 4/1949 | McCowan | 222/190 |
| 2,492,830 | 12/1949 | Bannister | 222/190 |
| 3,087,707 | 4/1963 | Moonan | 366/130 |
| 3,398,427 | 8/1968 | John | 425/149 |
| 3,698,605 | 10/1972 | Quisling | 222/190 |
| 4,592,492 | 6/1986 | Tidmore | 222/212 X |

FOREIGN PATENT DOCUMENTS

| | | | |
|---|---|---|---|
| 2231571 | 12/1974 | France | 222/211 |

*Primary Examiner*—H. Grant Skaggs
*Assistant Examiner*—Kenneth Noland
*Attorney, Agent, or Firm*—Julian C. Renfro

[57] ABSTRACT

A hand operated device for dispensing a solution in accordance with this invention comprises a dispenser container having generally cylindrically configured sidewalls made of resilient material, that can be readily squeezed by a lady or child. The container also has a bottom that is generally flat, and a fill opening at the top equipped with a closure cap. The preferred embodiment of this device has an external dispensing passage disposed along the sidewall of the container, with the inlet for the dispensing passage being operatively connected near the bottom of the container, and the discharge opening from the dispensing passage located adjacent an upper portion of the container. A plurality of non-floating beads are located in a bottom portion of the container, which beads are surrounded by solution. The sidewalls are capable of being squeezed inwardly by the hand of the user, with the deformation of the sidewalls causing the beads to undergo a significant amount of motion, and also causing the dispensing of a quantity of the solution from the dispensing passage. Advantageously, the motion of the beads serves to break up and disperse any lumps of material existing in the container.

8 Claims, 2 Drawing Sheets

HAND OPERATED SOAP DISPENSER

BACKGROUND OF THE INVENTION

Practically every user of bar soap has been confronted with the problem of dealing with a bar of soap that has become so small from extensive use as to be difficult to utilize when taking a shower or a bath. A thrifty user of bar soap will often try to save the soap remnant by trying to cause the remnant to congeal with a fresh new bar of soap, and in other instances, the thrifty user will place the remnant in a container partially filled with water in the hope of making a viscous liquid that can later be used in hand washing.

Neither of these procedures is entirely satisfactory, for in many instances the soap remnant will not satisfactorily adhere to the new bar, and many persons desiring to wash their hands will shun the gooey mixture that often results from trying to make liquid hand soap out of bar soap remnants.

It is known to provide a dispenser device for receiving a soap remnant, in which the remnant can dissolve, so that a person desiring to wash his or her hands can hopefully cause a suitable quantity of liquid soap to thereafter be dispensed from the container of the device into his or her hand. The McCowan U.S. Pat. No. 2,477,998 is illustrative of such a device, and this patentee provides a screen shelf in a lower part of the container, to prevent the cake of soap from tending to close off and clog the outlet or discharge portion of the device.

Studies and research with regard to the McCowan type of device showed that many types of soap remnants are slow to dissolve, with the result being that the user trying to wash his or her hands often does not receive a sufficiently concentrated portion of liquid soap at the time of manipulation of a push plunger of the type shown in McCowan's Bar Soap Dispenser. Unfortunately, Patentee McCowan did not provide any means serving to agitate the water and soap combination so as to break up any lumps of soap existing in the container, which, if utilized, might well have served to cause the creation of liquid soap of a suitable concentration.

Although not specifically designed for use with soap remnants, the Quisling U.S. Pat. No. 3,698,605 is a solution dispenser utilizing a perforated cage suspended just above the bottom of his container to allow liquid to pass through at such time as an atomizer bulb is manipulated by the user. Here, also, there is the absence of any means that would serve to bring about a sufficiently concentrated liquid soap mixture out of a collection of bar soap remnants.

It was in an effort to overcome the distinct disadvantages of these types of devices that the present invention was created.

SUMMARY OF THE INVENTION

In accordance with the present invention, a highly satisfactory device is provided for dispensing an effective soap solution formed from placing soap remnants in a container to which a suitable quantity of water is added. This device utilizes a container having a generally cylindrically configured sidewall, a bottom that is essentially flat, and a fill opening at the top, that is equipped with a closure cap.

The container utilized in accordance with this invention is constructed of non-rigid material, and has a dispensing passage preferably disposed along an external part of the sidewall of the container. The inlet for the dispensing passage is connected near the bottom of the container, and the discharge opening from the dispensing passage is located adjacent an upper portion of the container.

In accordance with this invention, a plurality of non-floating beads are located in a bottom portion of the container, which beads are surrounded by an aqueous solution, and quite importantly, the sidewalls of the container are capable of being squeezed inwardly by the hand of the user at such time as he or she wishes to obtain a small quantity of soap for hand washing or the like. At such time of sidewall deformation, the beads in the container are caused to undergo a significant amount of motion, serving to break up and disperse any lumps of soap existing in the container, and to cause such soap to mix into solution with the small amount of water placed from time to time in the container. The inward motion of the sidewalls also serves to bring about the dispensing of a suitable quantity of soap from the discharge opening located at the upper part of the dispensing passage.

As should therefore be seen, the combination of soft sidewall container and non-floating beads results in an effective arrangement for bringing about a thorough mixing of soap remnants with the small quantity of water added by the user to the container from time to time.

The closure cap for the container is preferably screw threaded to prevent undesired dislodgment from the container at the time the user squeezes the sidewalls of the container to bring about the dispensing of soap. I found it desirable to provide a small opening or aperture in the closure cap so that a small quantity of air can be taken in for reasons of pressure equalization, due to thermal expansion from outside heat or from barometric change. Unfortunately, the liquid soap tended to close and occlude the opening in the closure cap after just a few times of soap dispensing.

This undesired occluding of the aperture in the cap was remedied by the use of a loosely fitted component residing in such cap opening, with the arrangement being such that the user either deliberately or accidently moves the component to a sufficient extent that any soap buildup is broken away, and a sufficient aperture for the passage of air is established.

It is therefore a principal object of this invention to provide a hand operated device of inexpensive construction that serves as an entirely satisfactory means for automatically converting bar soap remnants into a solution readily usable for the washing of hands and the like.

It is another object of this invention to provide a hand operated device utilizing a soft sidewall container designed to receive soap remnants, with the manipulation of the container sidewall serving through the medium of a plurality of non-floating beads in the container to break up the soap remnants and thus provide liquid soap of a suitable concentration.

It is still another object of this invention to provide a soft sidewall container having an externally located dispensing passage extending along the sidewall and providing communication with the bottom of the container, with the user's squeezing of the container sidewalls not only causing the dispensing of a suitable quantity of liquid soap from the passage into the hand of the user, but also bringing about, as a result of sidewall manipulation and the interaction with a plurality of beads, the liquification of the discrete portions of bar soap that would otherwise tend to reside in the container.

These and other objects, features and advantages will become more apparent from a study from the appended drawings.

DETAILED DESCRIPTION

Figure 1:
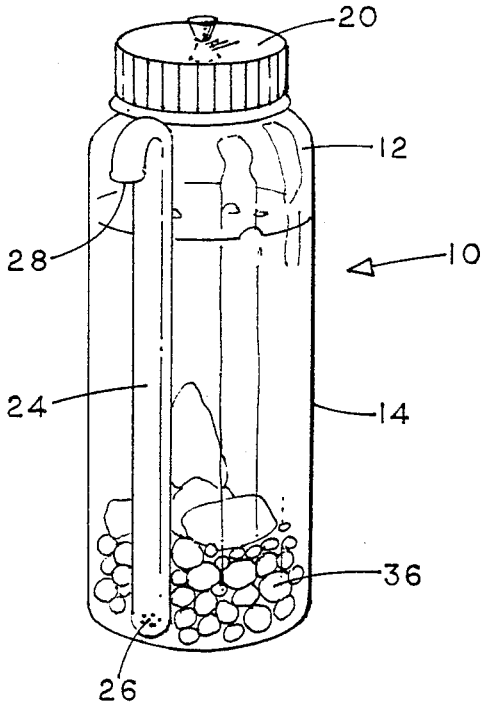
FIG. 1 is a perspective view of a preferred configuration of a hand operated solution dispensing device in accordance with this invention.

Turning now to FIG. 1 it will be seen that I have provided an exemplary version of a hand operated device 10 suitable for dispensing a solution, such as a solution made up of bar soap and water. The device principally comprises a dispenser container 12 having resilient, generally cylindrical sidewalls 14, with plastic or other non-rigid material preferably being utilized in the construction of the container.

Figure 5:
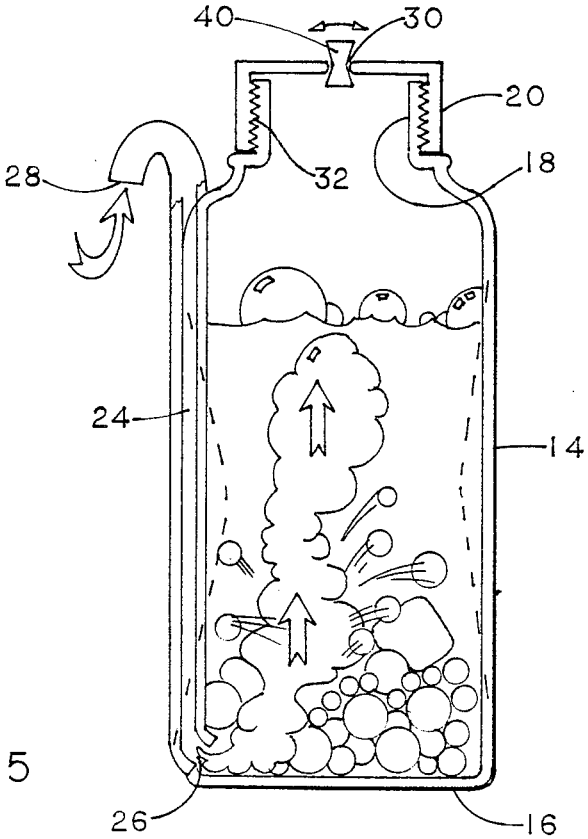
FIG. 5 is a vertical section view through a central portion of the device in accordance with this invention, with this figure revealing that the intake of air through the dispensing passage at the time of sidewall release results in a substantial quantity of incoming air, which in turn causes an additional agitation of the non-floating beads in the container, and further assuring the rapid elimination of lumps of soap from the container.

The container 12 has a bottom 16 that is generally flat, and a fill opening 18 at the top, with the bottom and the top being best seen in FIG. 5. Closure for the fill opening 18 is preferably made possible by the use of an internally threaded closure cap 20.

Figure 4:
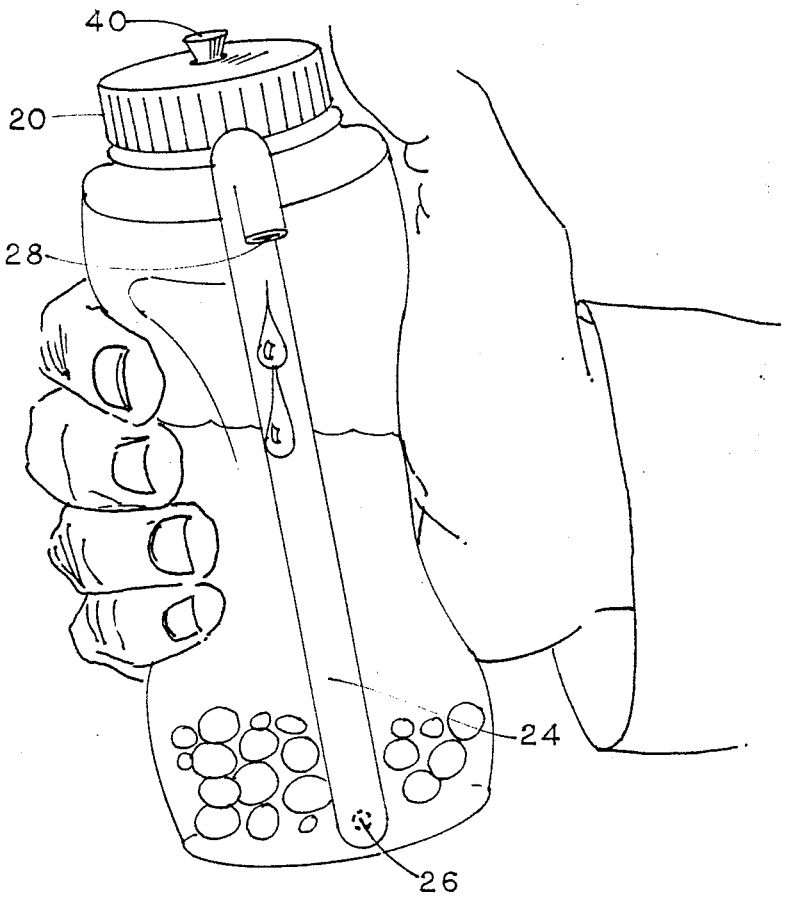
FIG. 4 is a perspective view of the device of this invention in use, with it being illustrated how the squeezing of the container sidewall in the hand of the user brings about the dispensing of soap from the dispensing passage of the device.

Continuing with FIG. 1, it will be seen that a dispensing passage 24 is provided along the outside of the sidewall 14 in a generally bottom to top manner, through which dispensing passage, a solution, typically a soap solution, is caused to flow at such time as the sidewall 14 is squeezed in the general manner illustrated in FIG. 4. Although the use of the dispensing passage is preferably on the outside of the container, as shown in these several figures of drawing, an embodiment of this invention could utilize a screw cap in which a central dispensing passage is utilized. In this latter event, the dispensing passage would extend not quite to the bottom of the container, and its inlet would be configured to prevent the ingesting of any of the non-floating beads 36 I utilize in the bottom of the container 12.

Figure 3:
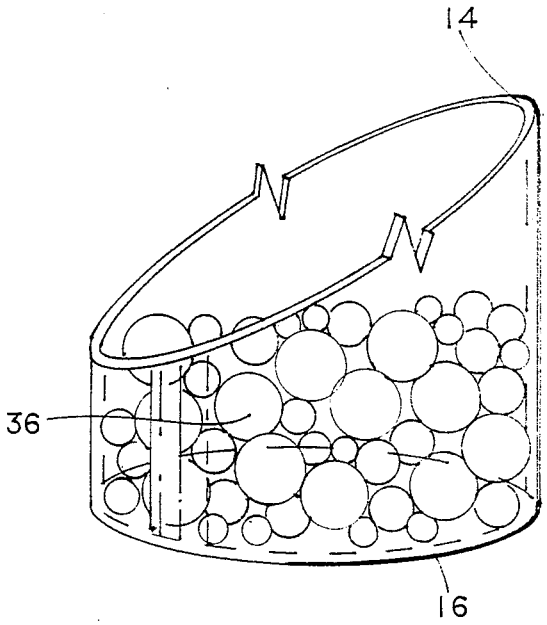
FIG. 3 is a fragmentary perspective view to a similarly large scale of the lower portion of the present solution dispensing device, illustrating the use of a number of non-floating beads in the bottom of the container, which serve to break up and filter out any lumps tending to remain in the container.

It is most important to note that a substantial quantity of the non-floating beads 36 are disposed in the bottom of the container 12, and FIG. 3 reveals that these beads are utilized in a plurality of different sizes in order to help eliminate lumps from the mixture in the container. None of such beads is so small, however, as to permit its entry into the inlet 26 to the dispensing passage, located at the bottom of the container 12. The inlet 26 of the dispensing passage may if desired be oblong.

Figure 2:
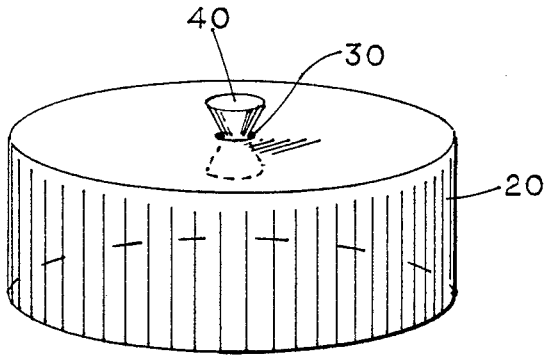
FIG. 2 is a fragmentary perspective view to a larger scale of a preferred cap configuration in accordance with this invention.

As will be noted in FIG. 1, but shown in greater detail in FIG. 2, the internally threaded closure cap 20 of the preferred embodiment is provided with a central aperture 30, which is important from the standpoint of pressure equalization. In view of the fact that many users of my device will from time to time be inserting their soap remnants through the fill opening 18, I prefer for the exterior portion of the fill opening to be provided with screw threads 32, as best seen in FIG. 5, such that the internally threaded closure cap 20 can be readily unscrewed, an additional soap remnant inserted, and then the closure cap restored to its proper position on the fill opening, and then tightened thereon.

After the closure cap has been sufficiently tightened, squeezing of the resilient sidewalls 14 in the general manner shown in FIG. 4 will bring about the dispensing of liquid soap from the discharge opening 28 of the dispensing passage 24, as also shown in this figure. Unfortunately, the use of my device in this manner tends to cause the central aperture 30 in the cap 20 to become clogged from the contents of the container, which is typically soap, and this undesirable consequence has caused me to provide a component 40 in the closure cap 20, which component is preferably captive in the cap.

As best seen in FIG. 5, the component 40 preferably has a narrowed central portion, with the portions above and below the central portion being somewhat larger. This central portion is slightly smaller in diameter than the aperture 30, and as a result of this advantageous design, the user can easily cause a rocking motion of the component 40, as will cause it to break away from any soap buildup, thus to restore the central aperture 30 to a functional condition in which it will permit the ingress or egress of air for pressure equalization purposes. It is also to be pointed out that the configuration of component 40 is such that at the time the container sidewall 14 is squeezed, the component 40 is pushed up slightly, causing it to momentarily seat on the underside of the central aperture 30, and thus prevent any substantial air flow out through the central aperture. Immediately after the user has released the resilient sidewalls from his or her grip, the component 40 tends to move under the influence of gravity, away from the seated position in which it closed the central aperture 30, such that a small quantity of air flow can then take place through the aperture.

As previously pointed out, the user's accidental or deliberate motion of the component 40 causes the restoration of the central aperture 30 to its proper functional condition, by the breaking up of any soap seal tending to form in the central aperture.

It is now to be seen that I have provided a highly effective and low cost container for receiving soap remnants otherwise discarded, whose sidewalls are resilient, but that nevertheless can be squeezed by a lady or a child for a sufficient amount to bring about the dispensing of soap at the behest of the user. It is important to note that the same squeezing motion resorted to in order to cause the dispersing of soap, also serves through the use of non-floating beads to provide a form of agitation that is most effective in helping break up the discrete portions of soap into very small, easily dissolved components.

As will be noted from an inspection of FIG. 5, when the non-rigid sidewalls are released from the grip of the user, the sidewalls rapidly move, as a result of their resilience, away from their dashed line positions, and return to their original configuration, as shown in solid lines in FIG. 5. This causes a quantity of air to be ingested at the opening 28, which air then emerges from the inlet 26 at the bottom of the container, and finds its way upwardly through the beads 36 and the lumps and remnants of bar soap to be found in the container.

It is thus to be seen that the squeezing of the container sidewalls and the ingested air each serve in connection with the substantial number of non-floating beads 36 to bring about a very thorough mixing of the bar soap remnants with the water in the container, such that any lumps otherwise tending to reside in the container will be effectively eliminated after a few times of use.

One container found satisfactory for use in accordance with this invention was a 16 oz. container manufactured by NALGENE under U.S. Pat. Nos. 3,398,427 and 3,534,435, but other resilient wall containers not too rigid for use by a lady or a child have also proven satisfactory.

Although I am not to be limited to any particular materials in the construction of my device, I may use a plastic such as low density polyethylene for the container, and the non-floating beads may be of plastic, ceramic, glass, or the like.

I claim:

1. A hand operated device for dispensing a solution, comprising a dispenser container having generally cylindrically configured sidewalls of resilient material, and a fill opening at the top equipped with a closure cap, the sidewalls of said container being constructed of non-rigid material that can be readily squeezed by a user, said container having a dispensing passage, with the inlet for said dispensing passage being operatively connected near the bottom interior of said container, and the discharge opening from said dispensing passage located adjacent an upper portion of said container and being non-valved, a plurality of non-floating beads residing in a bottom portion of said container, which beads are surrounded by solution, the deformation of said sidewalls at the time of being squeezed inwardly by the user causing said beads to undergo a significant amount of motion, and also causing the dispensing of a quantity of the solution from said dispensing passage, such motion of the beads serving to break up and disperse any lumps of material existing in said container.

2. The hand operated device as recited in claim 1 in which the solution is a soap solution, and any lumps of material are constituted by bar soap remnants.

3. The hand operated device as recited in claim 2 in which said closure cap is equipped with a central aperture permitting pressure equalization, and a component is captively mounted in said aperture, by the use of which component, the clogging of said aperture by soap residue is prevented.

4. The hand operated device as recited in claim 1 in which said plurality of beads is made up of a number of different bead sizes.

5. A hand operated device for dispensing a solution, comprising a dispenser container having a generally cylindrically configured sidewall, a bottom that is generally flat, and a fill opening at the top equipped with a closure cap, said container being constructed of non-rigid, resilient material, and having an external dispensing passage disposed along said sidewall, with the inlet for said dispensing passage being operatively connected near the bottom of said container, and the discharge opening from said dispensing passage located adjacent an upper portion of said container and being non-valved, a plurality of non-floating beads located in a bottom portion of said container, which beads are surrounded by solution, said sidewalls being capable of being squeezed inwardly by the hand of the user, with the deformation of said sidewalls causing said beads to undergo a significant amount of motion, and also causing the dispensing of a quantity of the solution from said dispensing passage, such motion of the beads serving to break up and disperse any lumps of material tending to exist in said container.

6. The hand operated device as recited in claim 5 in which the solution is a soap solution, and any lumps of material are constituted by bar soap remnants.

7. The hand operated device as recited in claim 6 in which said closure cap is equipped with a central aperture permitting pressure equalization, and a component is captively mounted in said aperture, by the use of which component, the clogging of said aperture by soap is prevented.

8. The hand operated device as recited in claim 5 in which said plurality of beads is made up of a number of different bead sizes.

* * * * *